US006568911B1

(12) United States Patent
Brightwell et al.

(10) Patent No.: US 6,568,911 B1
(45) Date of Patent: May 27, 2003

(54) COMPRESSOR ARRANGEMENT

(75) Inventors: Alan Brightwell, Holy Cross (GB); Philip John Wedge, Packington (GB)

(73) Assignee: Lattice Intellectual Property Limited, London (GB)

( * ) Notice: Subject to any disclaimer, the term of this patent is extended or adjusted under 35 U.S.C. 154(b) by 0 days.

(21) Appl. No.: 09/856,170

(22) PCT Filed: Dec. 2, 1999

(86) PCT No.: PCT/GB99/04034

§ 371 (c)(1),
(2), (4) Date: Jun. 27, 2001

(87) PCT Pub. No.: WO00/34655

PCT Pub. Date: Jun. 15, 2000

(30) Foreign Application Priority Data

Dec. 4, 1998 (GB) ..... 9826566
May 27, 1999 (GB) ..... 9912233

(51) Int. Cl.[7] ..... F04B 19/24
(52) U.S. Cl. ..... 417/53; 417/243
(58) Field of Search ..... 417/53, 393, 244, 417/254, 267, 256, 222.2, 62, 243; 72/391.6

(56) References Cited

U.S. PATENT DOCUMENTS

| | | | | |
|---|---|---|---|---|
| 2,411,020 A | | 11/1946 | Blasutta | |
| 3,838,941 A | * | 10/1974 | Roschupkin et al. | 417/62 |
| 4,236,875 A | * | 12/1980 | Widdowson | 417/222.2 |
| 4,383,804 A | * | 5/1983 | Budzich | 417/267 |
| 4,478,556 A | * | 10/1984 | Gozzi et al. | 417/256 |
| 4,515,516 A | | 5/1985 | Perrine et al. | |
| 4,653,986 A | | 3/1987 | Ashton | |
| 4,750,869 A | | 6/1988 | Shipman, III | |
| 4,761,118 A | * | 8/1988 | Zanarini | 417/254 |
| 5,324,175 A | * | 6/1994 | Sorensen et al. | 417/254 |
| 5,366,350 A | | 11/1994 | Fujii et al. | |
| 5,387,089 A | | 2/1995 | Stogner et al. | |
| 5,551,488 A | | 9/1996 | Gram | |
| 5,622,478 A | * | 4/1997 | Elliott et al. | 417/53 |
| 5,626,463 A | | 5/1997 | Kimura et al. | |
| 5,676,180 A | | 10/1997 | Teel | |
| 5,863,186 A | * | 1/1999 | Green et al. | 417/53 |
| 5,993,170 A | * | 11/1999 | Stevens et al. | 417/244 |
| 6,125,680 A | * | 10/2000 | Bradbury et al. | 72/391.6 |
| 6,435,843 B1 | * | 8/2002 | Hur | 417/393 |

FOREIGN PATENT DOCUMENTS

| | | |
|---|---|---|
| EP | 0 064 481 | 11/1982 |
| GB | 624 556 | 6/1949 |
| GB | 1 359 821 | 7/1974 |

* cited by examiner

*Primary Examiner*—Teresa Walberg
*Assistant Examiner*—Leonid M Fastovsky
(74) *Attorney, Agent, or Firm*—Oblon, Spivak, McClelland, Maier & Neustadt, P.C.

(57) ABSTRACT

A hydraulic compressor arrangement includes hydraulic rams A and B with associated non-return valves. A hydraulic pump, typically electrically operated, provides a pressurized fluid source to operate rams A or B to allow the associated chambers to receive and compress the low pressure gas provided by a valve. The rams A and B alternately compress and allow entry of the gas so as to produce a continuing source of compressed gas by a pipe to a gas storage tank by a quick release coupling. Two stage compression can also be utilized.

16 Claims, 4 Drawing Sheets

1
2
2a
3
4
5
6
7
8
9
10
11
12
13
14
15
16
18
19
21
22
A
B
I
II

COMPRESSOR ARRANGEMENT

The invention relates to a compressor arrangement for compressing a fluid, such as natural gas.

Motor vehicles, operating with compressed natural gas as an engine fuel, require the gas to be compressed to around 200 bar in order to store sufficient quantity in a volume comparable with liquid fuel. Conventionally reciprocating gas compressors have been used of the type using rotary movement to reciprocate the piston. Such reciprocating gas compressors usually operate with a number of stages in sequence such that the compression ratio in each stage is between 3:1 and 7:1. The operating speed of the piston in this type of compressor may be around 10 Hz and intercooling is provided between each compression stage to dissipate the heat generated when the gas is compressed. In these relatively high speed compressors, designs to achieve gas tight sealing are expensive particularly at pressures up to 200 bar.

The invention is concerned with providing a reduced cost arrangement with other advantages over the known arrangements.

According to the invention there is provided a fluid compressor having at least one stage of compression including two chambers each for receiving a first fluid to be compressed and means for receiving a source of second fluid under pressure to effect compression of the first fluid by reducing the volume within the chamber.

Preferably the compressor includes partition means in each chamber for separating the first and second fluids and switching means are provided to allow the source of pressurised fluid to alternate between each chamber to compress the first and second chambers alternatively by operating on the partition means.

Further according to the invention there is provided a method of compressing a fluid comprising the steps of providing the fluid to be compressed to a first or second fluid chamber, providing a source of pressurised second fluid to the first or second chamber to reduce the volume within the respective chamber to compress the other fluid.

Preferably the method includes the steps of: allowing the first chamber to open to receive the first fluid; thereafter reducing the size of the chamber to compress the fluid by means of the second pressurised fluid, and at the same time allowing the first fluid into the second chamber; and thereafter reducing the volume of the second chamber to compress, the fluid by means of the second pressurised fluid, and at the same time allowing the first fluid into the first chamber.

Hence in order to reduce the manufacturing cost and maintenance requirement for compressing relatively small volumes of gas, a slow moving hydraulically operated piston type compressor device is proposed. This utilises the ability of compact hydraulic pumps to deliver significant energy with a low volume flowrate of fluid at a pressure similar to the final gas pressure required (200 bar). In the proposed design, the speed of operation of the pistons is around 10 cycles/min rather than 10 cycles/sec (i.e. 60 times slower) thus reducing the wear rate on seals and allowing time for heat to dissipate. A higher speed version, with additional liquid cooling, for mounting on the vehicle could be employed but still of significantly lower speed. A further advantage of these designs is that the piston seals have more uniform pressures across them with the gas pressure being balanced by a similar or even higher hydraulic fluid pressure eliminating gas leakage across the seals.

High gas compression ratios, up to 250:1, can be achieved in a single stage compressor. Alternatively, a two stage version, with up to 15:1 compression ratio in each stage is possible with the added advantage of lower hydraulic oil flow rate and less peak power requirement, than in a single stage version, typically 1 L/min of oil flow for every 8 L/min of swept gas volume.

The invention will now be described with reference to the accompanying drawings in which.

Figure 1:
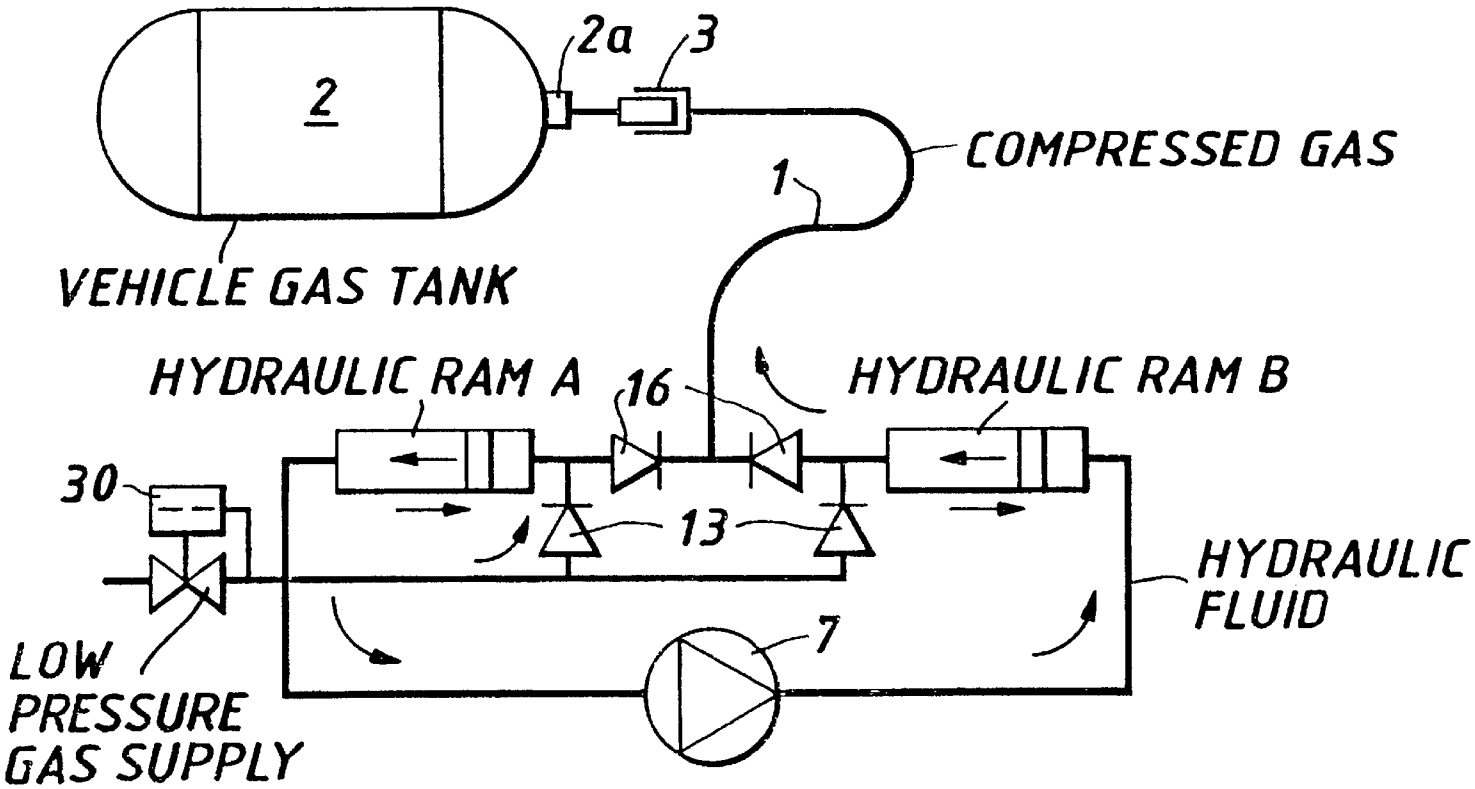
FIG. 1 shows a schematic simplified diagram of the hydraulic gas compressor.

The simplified compressor system of FIG. 1 shows the mechanisms employed to produce the slow moving compressor operated by hydraulic power by means of a bi-directional hydraulic pump 7, typically electrically driven.

The hydraulic compressor is envisaged as a direct replacement for any size of conventional multi-stage reciprocating compressor, however, in the proposal under consideration, the aim typically is to fill a 16 litre vehicle tank with compressed gas from a domestic supply as follows:

Low pressure gas via valve 30 is drawn into a hydraulic ram A, through a Non Return Valve (NRV) 13, as fluid via pump 7 is pumped to push gas out of a second ram B and NRV 16 into a vehicle fuel tank 2 with a volume reduction of 240:1 (the compression ratio for natural gas at 200 bar). The high pressure delivery hose 1 is connected to the tank inlet 2*a* via a quick release coupling 3. When the pump is reversed the duty on each ram changes so that gas previously drawn in is pushed out into the fuel tank whilst the ram in hydraulic suction is charged with low pressure gas ready for the next pump reversal. If the pump reversal is controlled on fluid volume, the outlet pressure will gradually rise until the fuel tank reaches 200 bar (240 volumes of gas at NPT).

In the arrangement, the fluid is always compressing gas and the pump moves only the minimum amount of fluid; 240×16=3,840 litres. For a fill time of 8 hours, the pumping rate is 8 litres/minute.

Figure 2:
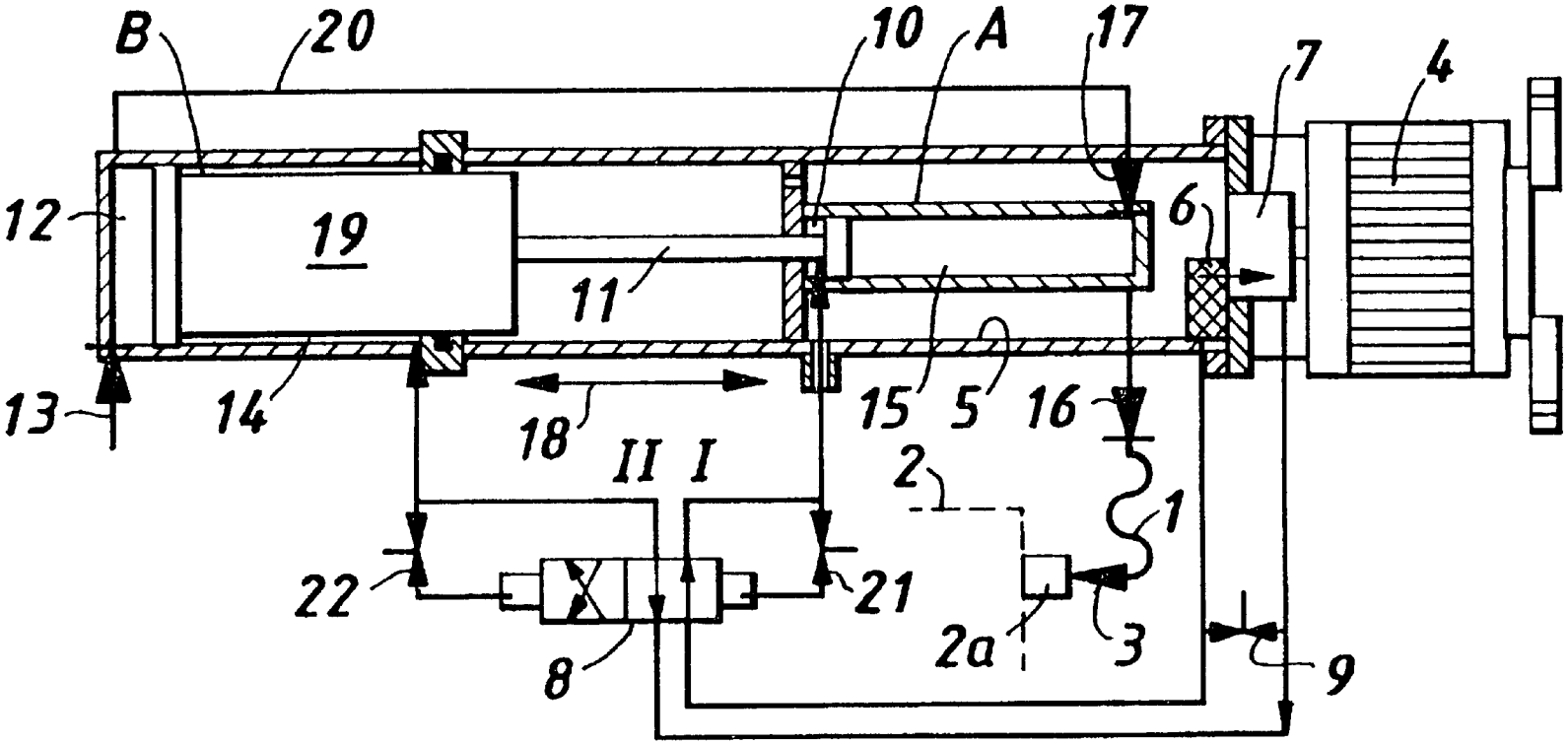
FIG. 2 shows a two stage compressor in more detail.
Figure 3:
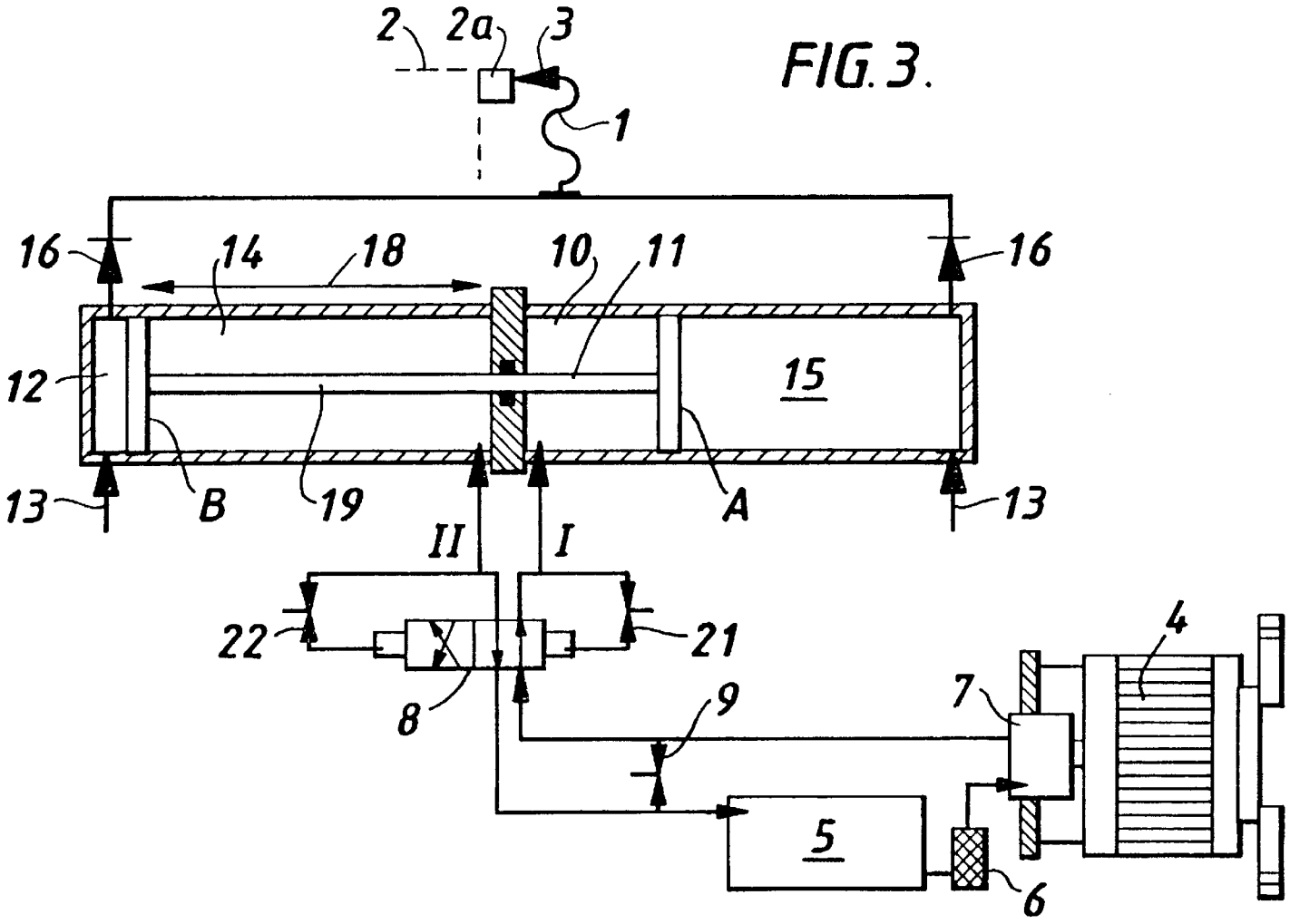
FIG. 3 shows the single stage compressor alternative.

This approach is adopted into the more detailed configurations of FIGS. 2 and 3. FIG. 3 shows a single stage version and FIG. 2 shows a two stage version.

As above, the system consists of an hydraulic power circuit linked directly and integrally with a gas compression circuit. A flexible hose delivery mechanism 1 with quick release coupling 3 is provided to deliver compressed gas to an external storage cylinder or tank 2 (partially shown in broken lines).

The hydraulic power circuit consists of a small electric motor 4 coupled to an hydraulic gear or piston pump 7. High pressure fluid output from the pump is connected to a spool type shuttle valve 8, pressure relief valves and two hydraulically opposed cylinders or rams A, B. Each ram has one fluid connection for flow/discharge to the shuttle valve. The low pressure or discharge from the shuttle valve is connected to a sump 5, containing a reservoir of hydraulic fluid. The hydraulic pump intake is connected via a filter 6 to a point on the sump which is gravitationally well below the fluid level.

The gas compression circuit consists of the two opposed cylinders or rams 12, 15 which are integral with the hydraulic rams. Each gas ram has two gas connections. One is for the gas inlet and the other is for higher pressure gas discharge. A non return valve 13 or 17 is fitted to the inlet and a non return valve 16 is at the outlet connection of each gas ram.

The high pressure gas delivery pipe is of a small bore flexible type fitted with a quick release coupling 3. A matching coupling is fitted to each high pressure gas storage cylinder. For motor vehicle applications, the storage cylinder is usually mounted under the vehicle body. To facilitate easy uncoupling from the storage cylinder, a bypass and relief circuit is provided to reduce the gas pressure in the delivery hose after filling of the cylinder is complete.

The hydraulic pump motor 4 is electrically operable and is energised by means of a trip relay switch (not shown). Hydraulic oil is drawn from the sump 5 at atmospheric pressure, via the filter 6, into the hydraulic pump 7. Rotation of the gears within the pump forces oil to flow into the spool valve 8 at high pressure. If the pressure exceeds a set value, typically 275 bar, then the relief valve 9 opens to allow oil to bypass the spool valve and flow back to the sump.

The spool valve is a shuttle operated type whereby oil may flow from one port and return to the other port or vice versa. The direction of flow is determined by the position of the spool inside the valve. This is a pressure operated bistable device. When the discharge pressure at port I reaches a set pressure, typically 270 bar, a relief valve 21 allows oil at this pressure to actuate the spool. This reverses the direction of flow through the outlet ports until the outlet pressure at port II reaches the pressure set by its relief valve 22, whereupon the flow reverts back to the original direction.

Low pressure oil entering the spool valve 8 is returned back to the sump 5 for cooling and continuous supply to the pump 7 whilst the pump motor 4 is running.

High pressure oil from the spool valve flows into the oil chamber 10 in hydraulic ram A. This pushes the piston A and simultaneously pulls the piston B by means of the ram rods 11 and 19. Piston B moves so as to enlarge the volume 12 in the gas chamber B. This induces gas to enter the chamber B via the non return valve 13 and low pressure gas supply line to the system. When piston A reaches the end of its permissible stroke 18 the oil pressure to hydraulic ram A rises rapidly, causing the spool valve 8 to change direction.

High pressure oil now flows from the spool valve 8 into hydraulic ram B at region 14. This pushes the piston B and simultaneously pulls the piston A by means of the ram rods 11 and 19. Piston A moves so as to enlarge the volume 15 in the gas chamber A and reduce the oil volume 10 in hydraulic ram A. This causes low pressure oil to flow back to the spool valve at port I from hydraulic ram A.

The movement of piston B reduces the volume 12 in gas chamber B and compresses the volume of gas induced on the previous stroke. The inlet non return valve 13 prevents gas returning to the supply line. (In FIG. 3 the outlet non return valve 16 allows the compressed gas to flow to the discharge.)

When piston B reaches the end of its permissible stroke 18 the oil pressure to hydraulic ram B rises rapidly to 270 bar causing the spool valve 8 to change direction again. The reversed oil flow pushes the piston A again and reduces the oil volume 14 in hydraulic ram B. This causes low pressure oil to flow back to the spool valve at port II from hydraulic ram B to complete one cycle of the compressor.

In the single stage arrangement of FIG. 3, the pistons A and B and their respective hydraulic oil and gas chambers are identical in size. The maximum piston travel distance or stroke 18 is the same for each piston. The gas outlets from each chamber A and B are connected in parallel to the high pressure gas discharge hose 1. When piston A is inducing gas, piston B is compressing gas and vice versa. The volume flowrates of hydraulic oil to induced gas are typically in the ratio 8:9. The peak hydraulic pressure is slightly larger than the peak gas discharge pressure, typically in the ratio 9:8. For a gas discharge pressure of 225 bar, the peak oil pressure might be 253 bar.

In the two stage arrangement of FIG. 2, the pistons A and B and their respective hydraulic oil and gas chambers are different in size. In the following description, the oil and gas volumes and their respective volume ratios refer to the maximum or swept volumes. Piston B has a large diameter providing a large volume 12 in gas chamber B. The oil volume in hydraulic ram B is much smaller than the gas volume since the connecting rod 19, at this point, is of large diameter creating an annulus of small hydraulic volume 14. The high ratio of gas to oil volume, typically 15:1 enables a small volume of hydraulic oil at high pressure, typically 225 bar, to compress a large volume of gas to medium pressure, typically 15 bar.

Although the maximum piston stroke 18 is also the same for each piston, in the two stage arrangement, piston A has a smaller diameter than piston B so that the ratio of volume 12 in gas chamber B to volume 15 in gas chamber A is typically 15:1. The oil volume 10 in hydraulic ram A is slightly smaller than the volume 15 in gas chamber A typically by the ratio 21:25 since the connecting rod 11, at this point, is of small diameter. Thus, a small volume of oil at high pressure, typically 268 bar, is able to compress gas from medium pressure, typically 15 bar, to high pressure, typically 225 bar.

The gas outlet from chamber B, the first stage, is connected via passageway 20 and a non return valve 17 to the gas inlet to chamber A, the second stage. When piston B is inducing gas, piston A is compressing gas. When piston B is compressing gas, the gas flows into gas chamber A such that the maximum compression ratio of stage 1 is defined by the area ratio of pistons B:A.

Typical Performance Data

| | Stages | Single | Two |
|---|---|---|---|
| Gas Flow rate | L/min | 8 | 8 |
| Gas Discharge Pressure | Bar | 225 | 225 |
| Delivered gas volume in 8 hour cycle | L | 3,840 | 3,840 |
| Equivaient petrol volume in 8 hour cycle | L | 4.65 | 4.65 |
| Hydraulic oil flowrate | L/min | 7.11 | 0.98 |
| Compressor interstage pressure | Bar | | 15 |
| Peak hydraulic pressure | Bar | 253 | 268 |
| Hydraulic power input (peak) | kW | 3 | 0.44 |
| Ratio of peak power (single:two stage) | | 6.85 | |

The design symmetry ensures that the pressure ratio across the piston is always low—the piston acting as a simple barrier between the hydraulic fluid and the gas. This feature reduces piston leakage and the need for high integrity piston seals in this linearly acting piston arrangement.

Figure 4:
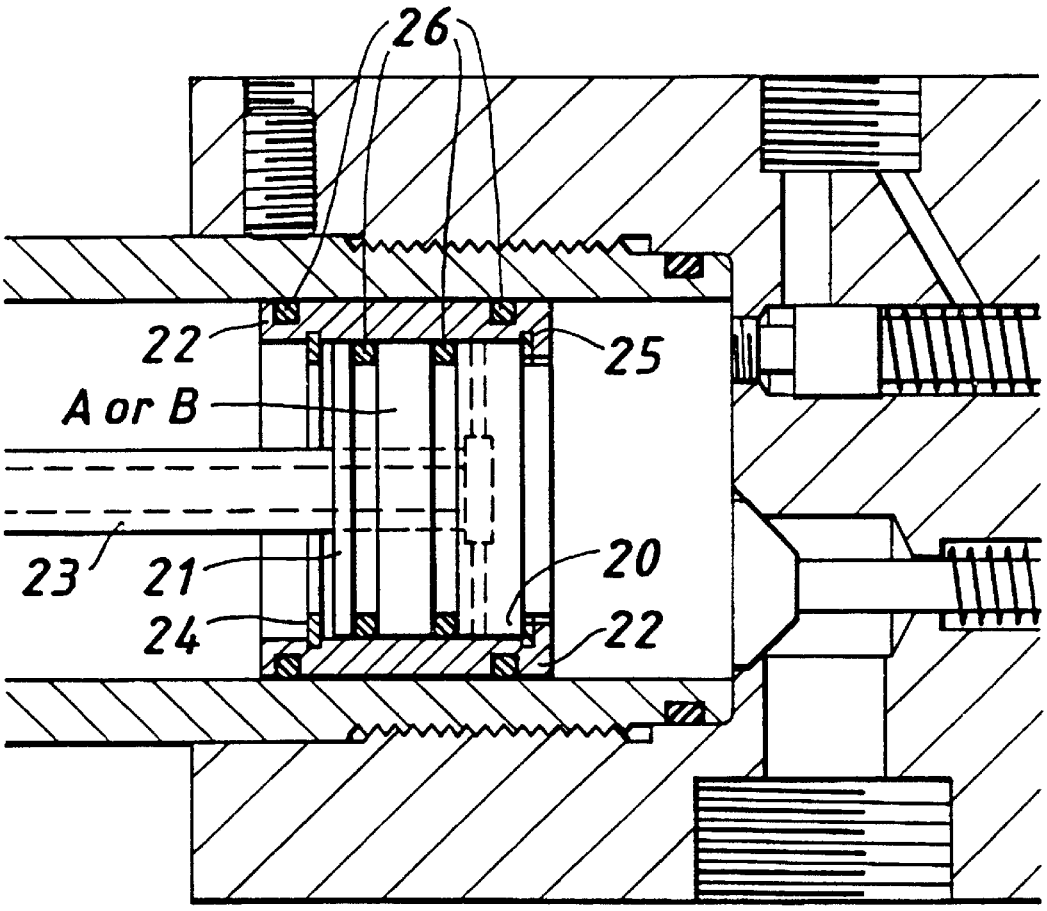
FIG. 4 shows details of a supercharger for a single stage compressor.

In the single stage arrangement of FIG. 3 an alternative can be provided as shown in FIG. 4 to deal with clearing remaining gas by venting into the opposite chamber. This deals with the trapped volume of high pressure gas remaining within either compression chamber at the end of the compression stroke—a feature caused by the basic geometry of any such assembly.

As the discharge pressure builds, the residual volume of high pressure gas remaining at the ends of the compression stroke (measured as an effective linear displacement) will increasingly reduce the swept volume of the next stroke.

At a discharge pressure of 200 barg, the effective stroke will reduce by 0.24 metres for every 1 mm of effective residual volume—because it is necessary to get the induction chamber pressure low enough through the displacement of the piston in order to allow a new charge of low pressure supply gas in.

The modification is intended to relieve the residual gas pressure by venting it into the opposing compression chamber at the point of fluid reversal when its induction stroke is complete and thus providing a small supercharge.

This feature is achieved, typically as shown, by incorporating a valve 20 within the piston (inner piston 21 and outer piston shell 22) which is opened at the instant of fluid reversal by the trapped pressure and remains open as the piston 21 is towed through its induction stroke—allowing high pressure trapped residual gas from the end of the compression stroke to pass along a hollow piston connecting rod 23 to supercharge gas in the opposing chamber which at the time of fluid reversal has completed its induction stroke. The opposing split piston re-seals as the hydraulic pressure builds for the compression stroke allowing the next charge of gas to be drawn in by the induction stroke—thereby maintaining an effective high swept volume at all pressures of compression and providing a small supercharge to the induction gas charge and thus ensuring a high pumping efficiency.

The piston is retained by clip 24 and abuts the soft seat 25. A number of ring seals 26 prevent unwanted fluid flow.

Thus the embodiments described above achieve gas compression with compression ratios well in excess of conventional values in at least one stage compression by using high pressure hydraulic fluid in a slow moving hydraulic/gas piston compression chamber.

Instead of the connecting rod being rigid, the rams of the single stage device could be interconnected by a flexible tensile member so that the chambers need not be in line, or some other mechanism could be employed to operate the rams which form the separators in the chambers. Further, the hydraulic fluid from the compressor could be passed to an external cooling device (e.g. heat exchanger or cooling coil) to further assist in cooling this fluid. This would be expedient at speeds in the region of 20 cycles/min.

The piston areas for hydraulic fluid could be identical or larger in the second stage compression portion to provide a longer stroke period to assist with cooling of the high pressure compression chamber.

The settings of valves 21 and 22 may be set at different values to allow the system to operate at two distinct control pressures.

The compressor, although shown horizontally in the drawings, may typically operate in a vertical mode.

In an alternative configuration the entire hydraulic circuit including the spool valve, relief valves and associated pipework could be enclosed within the external shell of the compressor so that any leakage of hydraulic fluid would only occur if the pump shaft seal failed or the external shell fractured.

With the quick release coupling, the hose could be configured to include coaxial bores so that any high pressure gas remaining on decoupling can be vented back to the compressor system or when the tank becomes full.

What is claimed is:

1. A fluid compressor having two stages of compression including first and second chamber, each for receiving a first fluid to be compressed;

means for receiving a second fluid under pressure in each of the first and second chambers to effect compression of the first fluid by reducing its volume;

a piston provided in each chamber to separate the first and second fluids, wherein at least the first stage piston has a piston area for the first fluid which is larger than the piston area of the pressurized fluid; and each piston is driven by a ram rod and the ram rods have differing diameters.

2. A compressor according to claim 1, including switching means to allow the source of pressurized fluid to alternate between each chamber to compress the first fluid in the first and second chambers alternately by operating on the pistons.

3. A compressor according to claim 1, wherein the two ram rods are interconnected to provide continuous fluid delivery at discharge pressure from one chamber whilst the other chamber is being recharged.

4. A compressor according to claim 3, wherein the two chambers lie on a central axis and they are interconnected via the interconnected ram rods.

5. A compressor according to claim 4, wherein the interconnected ram rods include a hollow fluid passage arranged to interconnect the first fluid portions of the chambers at particular positions of the interconnected ram rods.

6. A compressor according to any one of claims 1 to 5, including venting means for allowing any compressed fluid in a clearance volume of the first chamber to be automatically vented into the second chamber when the second chamber is being supplied with fluid at supply pressure towards the end of the intake stroke.

7. A compressor according to any one of claims 1 to 5, in which the two chambers are constructed within a single body to assist with cooling.

8. A compressor according to claim 3, wherein the two chambers are interconnected by means of a passageway so that the first fluid from the first chamber delivered during its delivery stroke enters the second chamber during its intake stroke to provide two stages of gas compression.

9. A compressor according to claim 8, wherein the passageway is external of the chambers and includes cooling means for assisting in cooling the fluid.

10. A compressor according to any one of claims 1 to 5, 8, and 9, wherein each chamber is identical in size and the degree of compression effected on the first fluid is identical within each chamber.

11. A compressor according to any one of claims 1 to 5, 8, and 9, wherein the means for effecting compression is configured to enable a small volume of second fluid to compress a larger volume of first fluid.

12. A compressor according to any one of claims 1 to 5, 8, and 9, including a sump within the body of the compressor to effect storage and cooling of the second fluid used for compressing the first fluid.

13. A compressor according to any one of claims 1 to 5, 8, and 9, wherein the operating speed is configure to be no greater than 20 cycles/minute.

14. A compressor according to any one of claims 1 to 5, 8, and 9, wherein the second fluid acts as a seal at an interface to the first fluid to assist in preventing leaks.

15. A compressor according to claim 2, including valve means operable to allow the second fluid to compress each chamber alternately whilst allowing the non-compressed fluid chamber to fill with the first fluid.

16. A method of compressing a first fluid comprising the steps of providing the first fluid to be compressed to a first or second fluid chamber, providing a source of pressurized second fluid to the first or second chamber to reduce the volume of the first fluid within the respective chamber to compress it and wherein a piston is provided in each chamber to separate the first and second fluids and wherein at least the first stage piston has a piston area for the first fluid which is larger than the piston area of the pressurized fluid and each piston is driven by a ram rod and the ram rods have different diameters.

* * * * *